US006094136A

United States Patent [19]

Wyman

[11] Patent Number: 6,094,136

[45] Date of Patent: Jul. 25, 2000

[54] BURGLAR ALARM PROTECTION SYSTEM

[76] Inventor: Paul Wyman, 66 Lawrence St., Haverhill, Mass. 01831

[21] Appl. No.: 09/239,045

[22] Filed: Jan. 26, 1999

[51] Int. Cl.[7] ..... G08B 13/00

[52] U.S. Cl. ..... 340/541; 340/571; 379/438

[58] Field of Search ..... 340/541, 540, 340/566, 571; 174/136, 683, 101; 379/437, 438, 434

[56] References Cited

U.S. PATENT DOCUMENTS

| | | | |
|---|---|---|---|
| 5,315,654 | 5/1994 | Kraft | 379/438 |
| 5,519,756 | 5/1996 | Clift | 379/44 |
| 5,764,729 | 6/1998 | Black et al. | 379/44 |
| 5,804,769 | 9/1998 | Morena | 174/136 |
| 5,889,855 | 3/1999 | Davis | 379/399 |
| 5,930,355 | 7/1999 | Poston | 379/451 |

*Primary Examiner*—Jeffery A. Hofsass
*Assistant Examiner*—Anh V. La
*Attorney, Agent, or Firm*—Frederick R. Cantor, Esq.; Arthur J. O'Dea, Esq.

[57] ABSTRACT

A home burglar alarm system, dependent on a telephone line for operability, can be protected by covering the exterior telephone wiring with an enclosure fastened to the building exterior surface. The enclosure conceals and physically shields the telephone wiring form attack by a would-be intruder. As back-up protection, the wiring enclosure is provided with an audible alarm system that is triggered by breakage or destruction of the enclosure.

4 Claims, 2 Drawing Sheets

BURGLAR ALARM PROTECTION SYSTEM

BACKGROUND OF THE PRESENT INVENTION SUMMARY OF THE PRESENT INVENTION

This invention relates to a protection system for a burglar alarm installation, and particularly to a protection system for a burglar alarm installation that relies on telephone lines to establish a communication link between the home alarm and a central station that monitors the alarm signal.

In one known burglar alarm installation a keypad in the home is connected to various sensors at potential break-in locations (usually exterior doors of the home). The keypad can be actuated to activate or deactivate the the sensors, using a code programmed into the keypad.

The keypad is linked to a central monitoring station through the existing telephone system. Should the sensors indicate a home break-in, a signal is sent from the home through the telephone line to the central monitor. Unless the homeowner countermands the break-in signal (by telephone contact with the central station), the human technician at the central station alerts the local police station to the break-in condition. In the optimum scenario, the police dispatched to the home are able to apprehend the burglars, at the home or after their departure.

The burglar alarm installation relies on the existing telephone system in order to be effective. Unfortunately many existing home telephone systems include telephone lines located on the exterior (external) surface of the home. Should a thief cut the external telephone line before attempting entry into the home, the burglar alarm installation becomes inactive (ineffective) for its intended purpose.

The present invention relates to a protection system for a burglar alarm installation, and particularly a protection system that provides a covering over the exterior telephone lines on the building that is being guarded by the burglar alarm. The aim of the invention is to protect the external telephone lines against being cut by a potential intruder.

The present invention will be better understood by reference to the attached drawings and description of an illustrative embodiment of the invention.

In summary, and in accordance with the above discussion, the forgoing objectives are achieved in the following embodiment.

1. A burglar alarm protection system comprising a protective covering adapted to overlie a telephone wiring assembly located on an external building surface, and an electrical alarm circuit extending along said protective covering, whereby dislocation or breakage of said covering activates said alarm circuit.

2. The protective system, as described in paragraph 1, wherein the telephone wiring assembly includes a telephone control box, a first telephone line extending out of the external building surface into said box, and a second telephone line extending out of said box and upwardly along the external building surface; and said protective covering comprising a housing adapted to overlie said first telephone line and a portion of said second telephone line, and a protective channel extending from said housing along said second telephone line.

3. The protective system, as described in paragraph 2, wherein said electrical alarm circuit comprises an audible alarm devise in said housing and a conductive sensor extending along said protective channel.

4. The protective system, as described in paragraph 2, wherein said electrical alarm circuit comprises an audible alarm device, battery power source and relay located in said housing.

5. The protective system, as described in paragraph 2, wherein said electrical alarm circuit comprises a conductive sensor extending along said protective channel; and said alarm circuit further comprising a battery power source, relay, and audible alarm device in said housing.

6. The protective system, as described in paragraph 5, wherein said relay comprises a controlled contact means operable to alternately connect said battery power source to said conductive sensor or to said audible alarm device.

7. The protective system, as described in paragraph 2, wherein said housing comprises a hinged cover openable to expose said first telephone line and a portion of said second telephone line extending out of said telephone control box.

DESCRIPTION OF THE PREFERRED EMBODIMENTS OF THE PRESENT INVENTION

Figure 1:
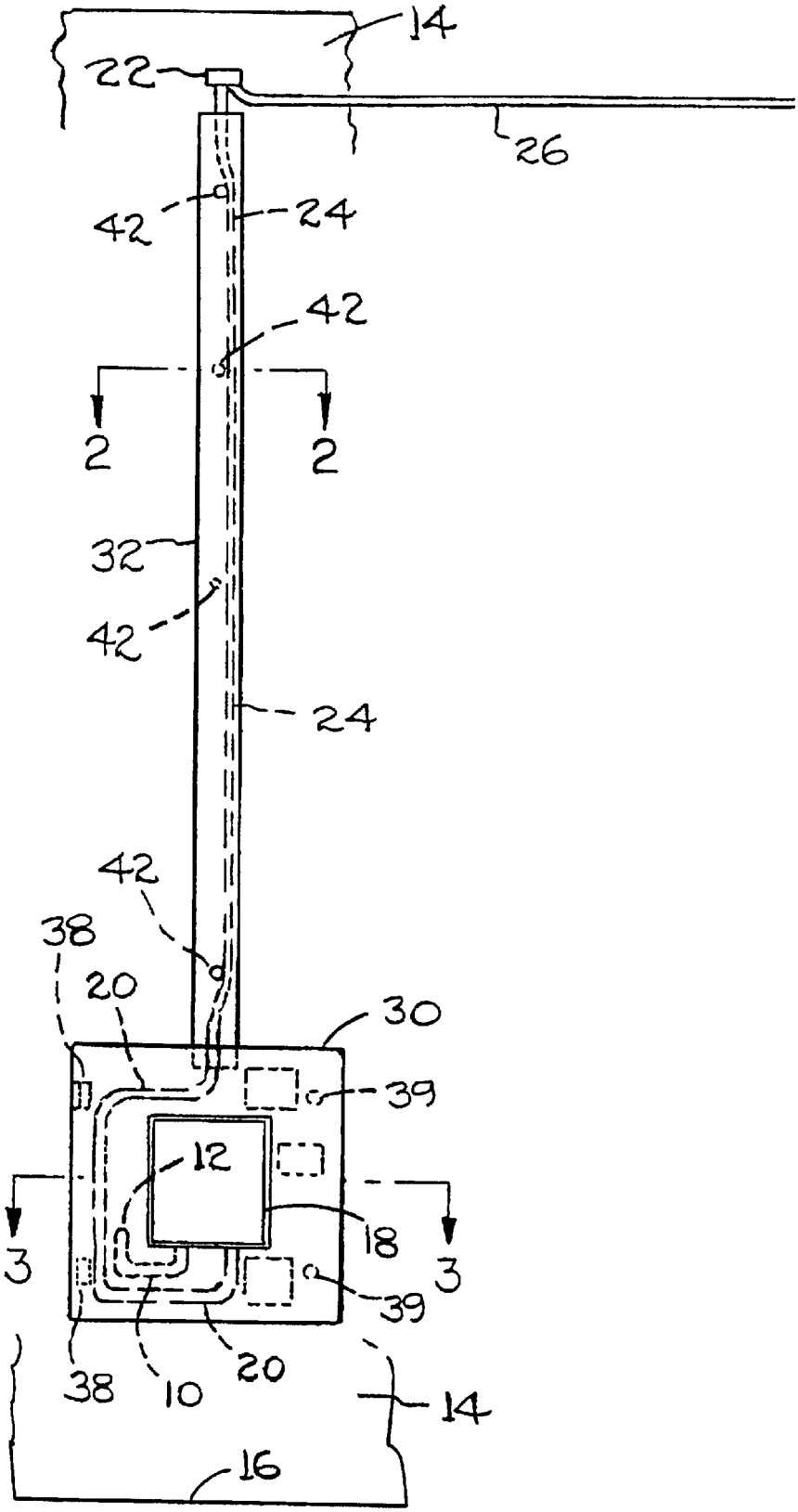
FIG. 1, is an elevational view, of telephone wiring located on an external building surface, and a protective covering for such wiring according to the invention.

FIG. 1, is an elevational view, of telephone wiring located on an external building surface, and a protective covering for such wiring according to the invention.

Referring to FIG. 1, there is fragmentarily shown a conventional telephone wiring assembly commonly found on the external surface of a residential building, e.g. a single family residence. As shown, the external telephone wiring assembly comprises a first relatively short telephone line 10 extending out of the building through a sealed opening 12 in the building exterior wall 14. Opening 12 is usually located one or two feet above the grade (ground) level 16.

Telephone line 10 extends from sealed opening 12 into a telephone control box 18 suitably mounted on building wall 14. A second telephone line 20 extends out of control box 18 along the building wall external surface. As shown in FIG. 1, telephone line 20 extends around a side surface of box 18 and thence upwardly to an anchorage 22 located at an elevated position on building wall 14. Typically anchorage 22 is spaced nine or ten feet above ground level 16.

Telephone line 20 has some slack between anchorage 22 and control box 18, such that section 24 of line 20 tends to gravitationally assume a vertical orientation extending dowardly from anchorage 22. Line 20 includes another section 26 that extends away from building wall 14 to connect with a main elevated telephone wire extending between a row of telephone poles, not shown.

The residential building can include a burglar alarm system having a telephone connection with the aforementioned telephone line 101 whereby the system generates a telephone signal through line 10 in response to an attempted break-in of the residence. Typically, the burglar alarm system includes a keypad located within the residence, and plural sensors at the building exterior doors. When a unique code is entered into the keypad, each sensor is activated to deliver an alarm signal to telephone line 10, responsive to opening of any exterior door by an intruder. The alarm signal is sent over the external telephone system to a central monitoring station, to alert a human operator to the break-in at the specific residence where the telephone signal originates. The human operator alerts the local police station, where a police officer can be dispatched to the scene of the break-in.

The burglar alarm system depends on a functioning telephone system in order to be effective for its intended purpose. Should the intruder cut the external telephone line before attempting to enter the residence, then the burglar alarm system will be rendered inoperable. The present invention is concerned with a protection system that covers the external telephone lines 10 and 20, between sealed opening 12 and elevated anchorage 22, whereby the intruder is deterred from cutting the external telephone lines.

The protection system includes an audible alarm that generates a loud warning sound (e.g. a sustained whistling noise or high pitched siren sound) when the intruder attempts to break or destroy the enclosure that covers telephone wire 10 and 20. The aim is to frighten the would-be intruder into leaving the area, rather than continuing with the break-in attempt. Preferably the audible alarm system is self-contained system located within the protective covering for the telephone wires.

As shown in FIG. 1, the protective covering for the external telephone wiring includes a rectangular housing 30 encircling telephone control box 18, and an elongated channel member 32 extending between housing 30 and anchorage 22 so as to cover section 24 of telephone line 20. Housing 30 covers telephone line 10 and the lower portion of telephone line 20. Housing 30 and channel member 32 collectively cover the exterior portion of the telephone wiring between sealed opening 12 and anchorage 22 so as to deter an intruder form attacking or cutting the telephone wiring. The deterrent effect is achieved by concealing the telephone wiring, and also by the physical resistance to cutting offered by the covering. Housing 30 and channel member 32 are preferably formed of a rigid plastic material resistant to the cutting action of a saw or scissors type cutter.

Housing 30 comprises a plate-like cover 33 having a peripheral flange 35 adapted to seat against a flat mounting plate 37 suitably affixed to building exterior surface 14. The left edge of cover 33 has a hinge connection 38 with mounting plate 37, whereby the cover can be opened to gain access to an audible alarm system mounted on plate 37. The cover is normally locked to plate 37 by two screws 39 having concealed heads.

Figure 3:
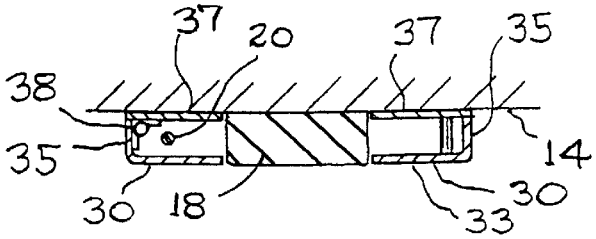
FIG. 3, is a sectional view, taken on line 3—3 in FIG. 1.

FIG. 3, is a sectional view, taken on line 3—3 in FIG. 1.

Mounting plate 37 has a central aperture adapted to fit around the pre-existing telephone control box 18 when plate 37 is initially installed on building surface 14. Additionally, plate 37 may be sectionalized to enable the plate to underlie the telephone wiring. As shown in FIG. 3, cover 30 has a central opening sized to fit on control box 18, whereby the box remains accessible to the telephone maintenance people. In areas where the telephone company does not require access to box 18, cover 30 could be made so as to completely cover the box.

Channel member 32 has its lower end extending through a semi-circular opening in the flange 35 of housing 30, to avoid any gap between the housing and channel member 32 the upper end of channel member 32 is in near proximity to anchorage 22.

Channel member 32 is positioned against an elongated mounting plate 40 that is suitably affixed to building surface 14. Mounting plate 40 extends substantially the entire distance between housing plate 37 and anchorage 22.

Figure 2:
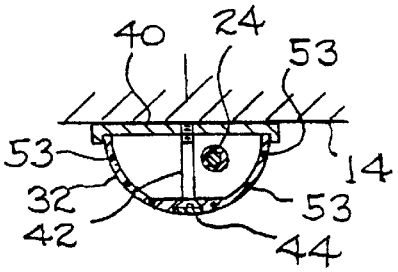
FIG. 2, is an enlarged sectional view, taken on line 2—2 in FIG. 1.

FIG. 2, is an enlarged sectional view, taken on line 2—2 in FIG. 1.

Securement screws 42 extend through channel member 32 into the mounting plate 40 at spaced points along the channel member 32. The head of each screw 42 may be concealed by a plug 44, (as seen in FIG. 2), so that the presence of each screw is obscured. In similar fashion, the head of each screw 39 can be concealed by a plug or ornamental clip.

It will be seen that housing 30 and channel member 32 collectively cover the exterior telephone wires 10 and 20 from sealed opening 12 to anchorage 22, so as to lessen the likelihood that a would-be intruder might attempt to cut the telephone wires so as to defeat an associated burglar alarm system dependent on the telephone line for operability.

Figure 4:
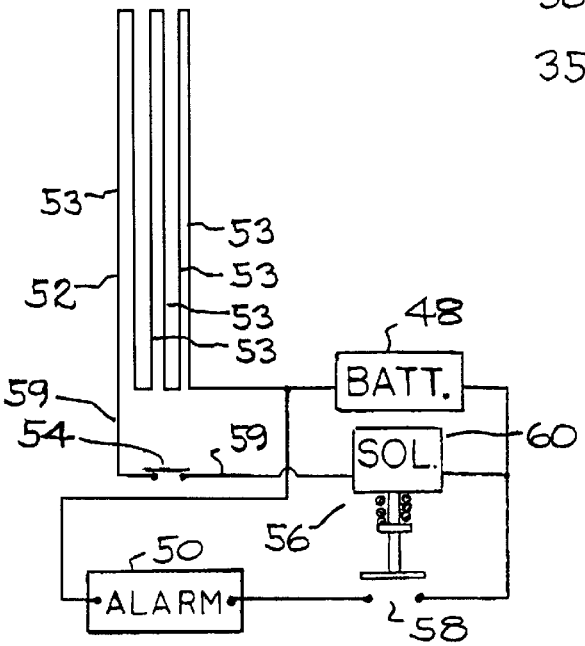
FIG. 4, schematically shows an alarm circuit used with the protective covering depicted in FIG. 1.

FIG. 4, schematically shows an alarm circuit used with the protective covering depicted in FIG. 1.

As a back-up for the protective covering 30, 32, there is provided an audible alarm system responsive to breakage or dislocation of the covering. FIG. 4 schematically shows an alarm system that can be used. As there shown, the alarm system comprises a battery power source 48, audible alarm 50, and two separate electrical sensors 52 and 54. A relay 56 has a controlled contact means 58 that is operable to alternately connect the battery power source 48 to sensors 52 and 54, or to audible alarm 50, depending on the condition of relay solenoid 60.

When sensors 52 and 54 are intact (conductive) battery current is delivered to the relay solenoid so that contacts 58 are open; alarm 50 is inactive. Should either sensor 52 or 54 break, the relay solenoid is de-energized so that the relay spring moves the relay switch to the circuit-closed condition, thereby energizing the audible alarm 50.

Sensor 52 consists of a sinuous conductive wire 53 embedded (encapsulated) within the wall of channel member 32. The wire extends back and forth along the length dimension of channel member 32, so that if the channel member is cut at any point therealong the wire will be broken to trigger the audible alarm.

Figure 5:
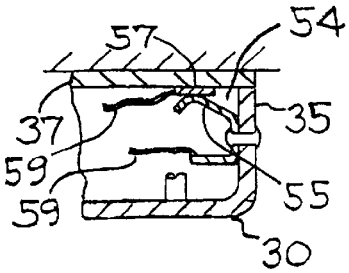
FIG. 5, is a fragmentary sectional view, of a structural detail employed in the FIG. 1 protective system.

FIG. 5, is a fragmentary sectional view of a structural detail employed in the FIG. 1 protective system.

Sensor 54 is shown in some detail in FIG. 5. As shown, the sensor comprises a conductive spring leaf 55 carried by cover 30 and a conductive contact strip 57 located on mounting plate 37. The leaf and conductive strip are attached to wires 59 that interconnect solenoid 60 with sensor 52 (FIG. 4).

When cover 30 is in the closed condition, as shown in FIG. 5, sensor 54 completes the circuit across elements 55 and 57. Should an intruder break open housing 30, the spring leaf 55 will separate from strip 57, thereby interrupting the circuit and triggering alarm 50.

The audible alarm system is responsive to breakage or destruction of the protective covering for the telephone wires 10 and 20. Should protective channel 32 be broken by an intruder sensor 52 will break to trigger the alarm. Should protective cover 30 be opened by an intruder, sensor 54 will trigger the audible alarm.

However, it will be appreciated by those skilled in the arts pertaining thereto, that the present invention can be practiced in various alternate forms, proportions, and configurations. Further, the previous detailed description of the preferred embodiment of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A burglar alarm protection system comprising:

a telephone control box mounted on an external building surface;

a first telephone line extending out of the external building surface into said telephone control box;

a second telephone line extending out of said telephone control box and upwardly along the external building surface;

a protective covering comprising a housing encircling said telephone control box, and a cover adapted to overlie said first telephone line and a portion of said second telephone line;

a protective channel extending from said housing and covering said second telephone line; and an electrical alarm circuit that generates an audible sound upon breakage or dislocation of said protective covering or said protective channel.

2. The burglar alarm protection system, as described in claim 1, wherein said electrical alarm circuit further comprises an audible alarm device in said housing having a conductive sensor embedded within the wall of said protective channel.

3. The burglar alarm protection system, as described in claim 1, wherein said cover is openable to expose said first telephone line and a portion of said second telephone line extending out of said telephone control box; and said cover having an opening for access to said telephone control box by maintenance people when closed.

4. The burglar alarm protection system, as described in claim 1, wherein said electrical alarm circuit further comprises a conductive sensor comprising a sinuous conductive wire embedded within the wall of said protective channel, whereby an attempt to break or destroy said protective channel by one seeking to tamper with said second telephone wire will trigger an audible alarm.

* * * * *